United States Patent [19]

Gladstone et al.

[11] Patent Number: 4,718,323

[45] Date of Patent: Jan. 12, 1988

[54] THERMO-ELECTRONIC SYSTEM TO CORRECT FOR THERMAL DEFORMATION OF A RESTRAINED PLATE

[75] Inventors: David H. Gladstone, Quebec; Jacques Dubois, Neufchatel; Raymond Carbonneau, Cap Rouge; Gedeon Drouin, St-Foy, all of Canada

[73] Assignee: Her Majesty the Queen in right of Canada as represented by the Minister of National Defence, Canada

[21] Appl. No.: 852,981

[22] Filed: Apr. 16, 1986

Related U.S. Application Data

[63] Continuation-in-part of Ser. No. 794,715, Nov. 4, 1985, abandoned.

[30] Foreign Application Priority Data

Dec. 3, 1984 [CA] Canada ..... 469141

[51] Int. Cl.[4] ..... F41G 3/08

[52] U.S. Cl. ..... 89/41.03; 73/167; 89/36.13; 374/7; 374/12; 374/141

[58] Field of Search ..... 374/163, 121, 7, 12, 374/169, 172, 52, 55, 32; 89/41.03, 41.19, 36.08; 356/153; 73/167; 33/235, 237

[56] References Cited

U.S. PATENT DOCUMENTS

| | | | |
|---|---|---|---|
| 3,218,859 | 11/1965 | McBride et al. | 374/112 |
| 4,114,448 | 9/1978 | Merritt | 374/112 X |
| 4,142,799 | 3/1979 | Barton | 356/153 |
| 4,441,405 | 4/1984 | Takeuchi | 374/112 X |

*Primary Examiner*—Daniel M. Yasich

*Attorney, Agent, or Firm*—William R. Hinds

[57] ABSTRACT

The thermal deformation of an edge-restrained plate is expressed as a deflection of the plate out of its plane. Where the plate is used as a reference plane, the deformation of the plate can be quantitatively monitored and compensated for. In the case of a radiantly heated plate, the temperature gradient adjacent an edge of the plate is a linear function of the plate deformation. With convective cooling, the temperature drop from an initial condition relates linearly to deformation. Consequently, relatively simple temperature measurements will provide the necessary information. The invention has particular application to the roof of a military tank turret that is used as a reference plane for a gun sighting system.

7 Claims, 8 Drawing Figures

THERMO-ELECTRONIC SYSTEM TO CORRECT FOR THERMAL DEFORMATION OF A RESTRAINED PLATE

CROSS-REFERENCE TO RELATED APPLICATIONS

This application is a continuation-in-part of application Ser. No. 794,715, filed Nov. 4, 1985, now abandoned.

FIELD OF THE INVENTION

The present invention relates to a system for monitoring thermal deformation of an edge-restrained plate, that is a plate with its peripheral edge secured to another structure so that the plate is restrained against free thermal expansion and contraction.

BACKGROUND

The thermal expansion of an edge-restrained plate results in a "humping" of the plate. If the plate is being used as a reference plane for sensitive equipment, the thermal deformation will be felt by the equipment as an undesirable rotation of the reference plane. In some applications, an angular error as small as one mrad can be of significance. For example, where the plate is a roof of a tank turret and a gun sight is mounted on the roof, a one mrad deflection of the sight can represent, for a target 4 km away, an increase of over 4 meters in the impact point of a shell. This will very seriously degrade the sighting accuracy of the gun.

While thermal deformation can be measured directly using mechanical or optical techniques, the mechanisms available are practical only in a laboratory environment and are unsuited for use in a difficult or extreme environmental conditions.

Experimental studies have now shown that with a radiantly heated edge restrained plate, the flow of heat from the center of the plate to the restraining edges produces a significant temperature gradient in the edge area. It has also been found that the angular deflection of the plate at a given point is a linear function of this temperature gradient. Thus, the angle of rotation at any given point on the plate can be determined from the equation:

$$\theta = K1\Delta T \quad (1)$$

Where $\theta$ is the angle of plate rotation at the location in question;

$\Delta T$ is the temperature differential between two reference points on the plate; and K1 is a constant with a value dependent on the location of interest on the plate and the positions where the temperatures are measured.

The constant K1 may be determined either experimentally or using an analytical model of the edge restrained plate.

Further analytical studies has shown that with an edge-restrained plate that is convectively cooled, the rotation of the plate from an initial state is a linear function of the difference between the actual plate temperature and an initial temperature at the initial state. Thus, the angle of rotation at any given point on the plate can be determined using the equation:

$$\theta = K2(TT - T\,\text{INITIAL}) \quad (2)$$

Where $\theta$ is the angle of plate rotation at the location in question;

T is the measured plate temperature at a given point;

T INITIAL is the initial temperature of the plate at the point where T is measured; and K2 is an experimentally or analytically determined constant.

The above equations can be used to monitor changes in the orientation of an instrument due to thermal deformation of an edge-restrained plate on which the instrument is mounted. Once the orientation changes are known, compensating corrections can be made.

SUMMARY

According to one aspect this invention provides, in a system comprising an instrument mounted on an edge-restrained plate, a method and an apparatus for monitoring changes in the orientation of the instrument due to thermal deformation of the plate caused by radiant heating thereof. According to this aspect of the invention:

a first temperature measuring means measures a first plate temperature at a first location spaced from an edge of the plate and generates a first temperature signal representative of the first plate temperature;

a second temperature measuring means measures a second plate temperature at a second location between the first location and the edge of the plate and generates a second temperature signal representative of the second plate temperature;

a signal processing means processes the first and second temperature signals and produces a deflection signal proportional to the angular deformation of the plate where the instrument is mounted; and a monitoring means monitors the deflection signal as a measure of changes in the instrument orientation.

According to another aspect of the present invention there is provided, in a system comprising an instrument mounted on an edge-restrained plate, a method and an apparatus for monitoring changes in the orientation of the instrument due to thermal deformation of the plate caused by convective cooling thereof. According to this aspect of the invention:

a recording means records an initial temperature of the plate and generates an initial temperature signal representative of the initial plate temperature;

a temperature measuring means measures the actual plate temperature at a fixed location spaced from an edge of the plate, and generates an actual temperature signal representative of the plate temperature;

a signal processing means processes the actual and initial signals and produces a deflection signal proportional to the angular deformation of the plate where the instrument is mounted; and a monitoring means monitors the deflection signal as a measure of changes in the instrument orientation.

For either aspect, the deflection signal can be used as a control signal for adjusting the instrument or its output to compensate for the deflection.

The invention was developed in conjunction with thermal deformation of a roof of a tank turret. Thus, a further aspect of the invention provides, in a military tank or the like having a turret carrying a gun and a gun sight mounted on a roof of the turret, a system for correcting the sight to compensate for thermal deformation of the turret roof, comprising:

mounting means for mounting the sight on the turret roof;

means linking the sight to the gun for training the sight and gun on a common target;

sight adjustment means for adjusting the aim of the sight relative to the gun;

first temperature measuring means for measuring a first plate temperature at a first location spaced from an edge of the plate and generating a first temperature signal representative of the measured first temperature;

second temperature measuring means for measuring a second plate temperature at a second location between the first location and the edge of the place and generating a second temperature signal representative of the measured second temperature;

initial temperature recording means for recording an initial temperature and generating an initial temperature signal;

signal processing means for combining and processing the first, second and initial temperature signals to produce a deflection signal proportional to the angular deformation of the plate at the mounting means; and circuit means for feeding the deflection signal to the sight adjustment means for adjusting the aim of the sight to correct for plate deformation.

BRIEF DESCRIPTION OF THE DRAWINGS

In the accompanying drawings, which illustrate an exemplary embodiment of the present invention.

DETAILED DESCRIPTION

Figure 2:
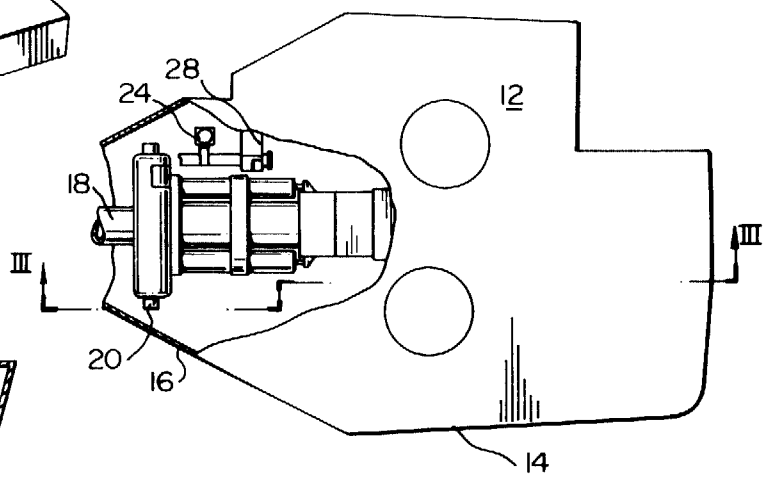
FIG. 2 is a plan view of the turret, partially broken away showing sctions of the gun and sight.
Figure 1:
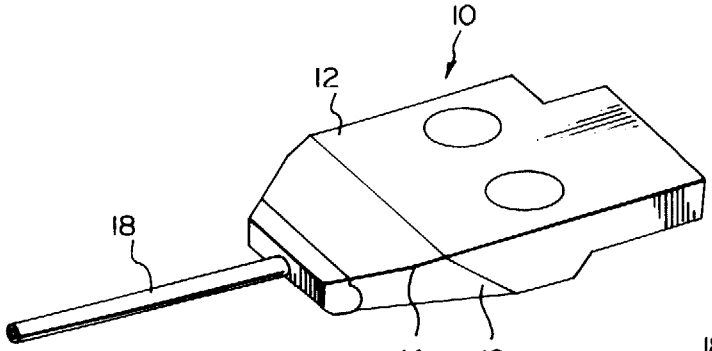
FIG. 1 is a perspective view of a tank turret.
Figure 3:
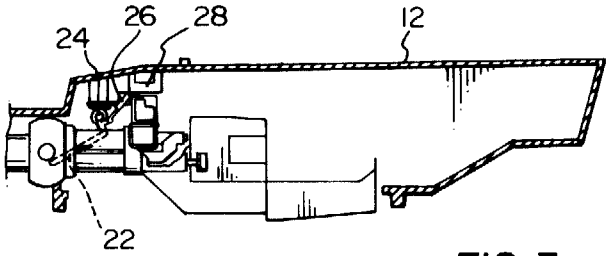
FIG. 3 is a sectional view along line III—III of FIG. 2.

Referring to the drawings and particularly to FIGS. 1, 2 and 3 there is illustrated a tank turret 10 with a roof 12 formed from a metal plate. The peripheral edge 14 of the roof 12 is permanently fixed to turret side plates 16, which restrains the roof edge against deforming in response to temperature changes. The turret carries a gun 18 mounted in trunions 20 (FIG. 2) so that it can be elevated and depressed. A mechanical linkage 22 connects the gun to a resolver 24 mounted on a support attached to the roof 12 of the turret. The resolver feeds on electrical signal corresponding to the gun elevation angle to a gunner's sight 28 that is also mounted on the roof plate 12 of the turret. This system trains the gun and the sight on a common target. Both the resolver and the sight use the turret roof as a reference plane and can thus be thrown out of alignment where the reference plane is deformed.

Figure 4:
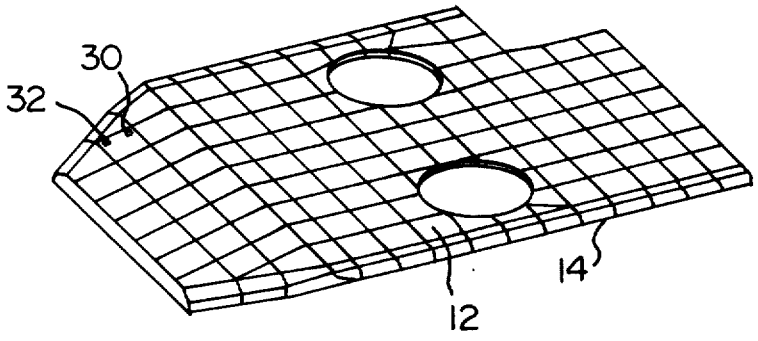
FIG. 4 is a perspective view of the turret roof in a standard condition, not thermally deformed.

Referring to FIG. 4, the roof plate 12 of the turret 10 is shown with a superimposed grid. As will be observed, the plate is in the main flat with a front "slant plate" section that slopes slightly downwards. The peripheral edge 14 of the plate is secured to the side plates 16 of the turret and consequently is restrained against free movement in response to heating or cooling of the roof plate 12.

Figure 5:
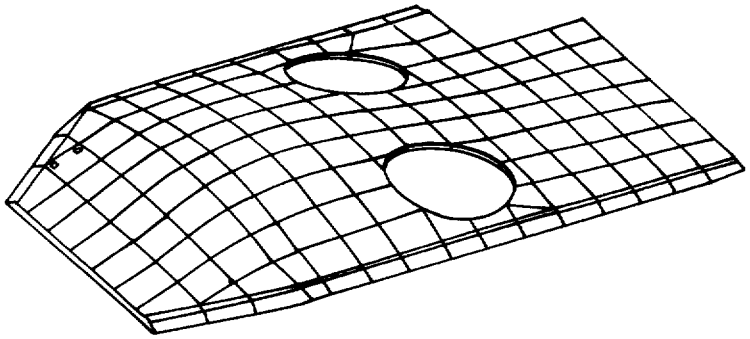
FIG. 5 is a view like FIG. 4 of the turret roof deformed by radiant heating from above.

FIG. 5 illustrates the roof plate 4 after it has been subjected to radiant heating from above, such as solar radiation. It will be observed that the plate has "humped" in the center, which will produce a rotation of the resolver and gun sight that use the plate as a reference plane.

Figure 6:
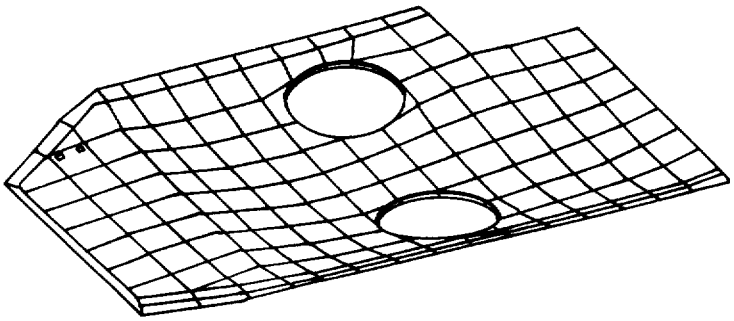
FIG. 6 is a view like FIGS. 4 and 5 of the turret roof deformed by convective cooling.

FIG. 6 shows a view like FIG. 5 where the plate has been subjected to convective cooling, as would occur after sunset. The roof has adopted a "dished" configuration, causing misalignment of the resolver and sight.

Figure 7:
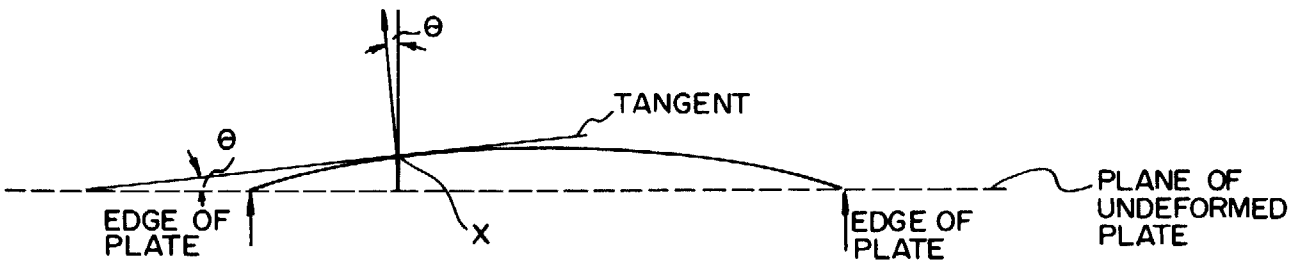
FIG. 7 is a schematic section of the heated turret roof.

The misalignment of an instrument on the roof plate is expressed as a rotation of the instrument out of its proper orientation. This is illustrated schematically in FIG. 7. The plane of the undeformed plate is shown in broken line, and the "humped" configuration of the heated plate in solid line. The location of the instrument mounting is at the position designated X. A tangent to the plate at that position forms an angle $\theta$ with the plane of the undeformed plate, which also defines the angular deflection of the instrument from a normal to the plane of the undeformed plate.

To monitor plate deformation, two temperature sensors 30 and 32 (FIG. 4) are mounted on the roof plate 12. The sensor 30 is spaced from the front edge of the roof, while the sensor 32 is located between the sensor 30 and the edge. The sensors can thus be used to measure the temperature gradient in this region of the plate. It has now been shown that this temperature gradient is a linear function of the angular deflection of the plate at any given point when the plate is subject to radiant heating and deforms as illustrated in FIG. 5. In the case of convective cooling and deformation as illustrated in FIG. 4, the rotation of the roof is a linear function of the difference between the temperature at one of these points and an initial temperature of the plate at the beginning of convective cooling. The reason for the difference between the two modes of plate behaviour appears to be the result of the difference between radiant heating and convective cooling. For radiant heating, the heat input is independent of the roof temperature, while with convective cooling the heat loss is proportional to the difference between the plate and ambient temperatures.

The "switch over" between the heating and cooling modes occurs at the point where the temperature sensed by sensor 32 is equal to the initial temperature. When the initial temperature is less than the temperature at sensor 32, the heating mode applies. When the temperature at sensor 32 is less than the initial temperature, the cooling mode is in effect.

In the embodiment of the invention being described, the fire control system for the gun includes a ballistic computer which accepts range signals from a range finder plus information from a series of non-standard condition sensors sensing such conditions as crosswinds, atmospheric pressure, powder temperature, air temperature and gun barrel wear. The computer automatically transforms the information from those sensors into azimuth and elevation corrections that are applied to the gun sight to adjust the position of the graticule on the field of view observed by the gunner. The deflection monitoring system is integrated with this fire control system to provide automatic correction for turret roof deformations.

Figure 8:
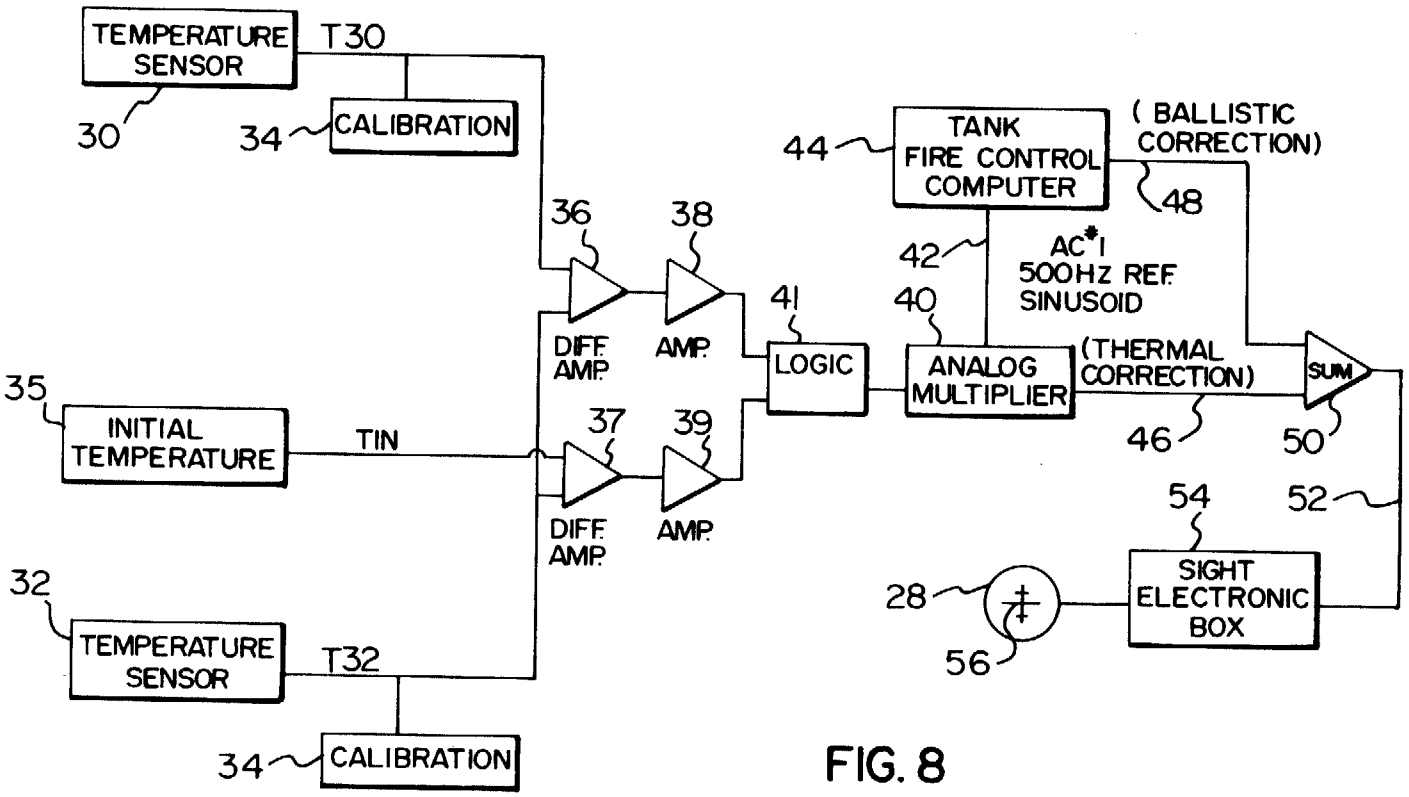
FIG. 8 is a block diagram of an electric circuit which can be used for correcting a tank gun sight for thermal deformations of the turret roof.

Referring to FIG. 8, the two temperature sensors 30 and 32 generate signals T30 and T32 representative of the temperatures of the plate where the sensors are located. The sensitivity and balancing of the temperature sensors is adjusted with calibrators 34. The technique for doing this is well known in the art and will not be further described. A recorder 35 generates an initial temperature signal TIN. The initial temperature can be set either manually or automatically.

The signals T30 and T32 from the temperature sensors 30 and 32 are fed to a differential amplifier 36 which provides a signal representing the difference between the two temperatures (T30−T32). The difference signal is passed through a variable gain amplifier 38 which amplifies the signal by a factor corresponding to the constant K1 in equation (1). The TIN signal from the recorder 35 and signal T32 are fed to a differential amplifier 37 which provides a signal representing the difference between these two signals (T32−TIN). The difference signal is passed through an amplifier 39 which amplifies the signal by factor K2. The two signals K1 (T30−T32) and K2 (T32−TIN) are passed through a logic circuit 41 which passes K1 (T30−T32) when T32 is greater than TIN, the case for radiant heating, and otherwise passes K2 (T32−TIN). The signal from the circuit 41 is fed to an analog multiplier 40 which also receives a sinusoidal 500 Hz reference signal 42 from the fire control computer 44. The two signals are multiplied and multiplier 40 puts out a thermal correcting signal 46 that is compatible with a ballistic correction signal 48 from computer 44. The thermal and ballistic correction signals 46 and 48 are added in an adder 50 to provide a final composite correcting signal 52 that is fed to the electronic controls 54 of the sight 28 to adjust the position of the graticule 56.

While one embodiment of the invention has been described, it is to be understood that the invention is not limited to that embodiment. Thus, the invention is not limited in its application to the roof of a military tank, but can be used in any case where thermal deformation of an edge-restrained plate is to be monitored or compensated. Some applications will not require both the radiant heating and convective cooling computations as both effects may be be a problem. It is therefore intended that the scope of this invention be limited solely by the appended claims.

We claim:

1. In a system comprising an instrument mounted on an edge-restrained plate, a method of monitoring changes in the orientation of the instrument due to thermal deformation of the plate caused by radiant heating thereof, the method comprising:

measuring a first plate temperature at a first location spaced from an edge of the plate;

measuring a second plate temperature at a second location between the first location and the edge of the plate;

generating first and second temperature signals representative of the measured first and second temperatures respectively;

combining and processing the first and second temperature signals to produce a deflection signal proportional to the angular deformation of the plate where the instrument is mounted; and monitoring the deflection signal as a measure of changes in the instrument orientation.

2. A method according to claim 1, including the additional step of adjusting the instrument according to the deflection signal to compensate for thermal deformations of the plate.

3. In a system comprising an instrument mounted on an edge-restrained plate, apparatus for monitoring changes in the orientation of the instrument due to thermal deformation of the plate caused by radiant heating thereof, the apparatus comprising:

first temperature measuring means for measuring a first plate temperature at a first location spaced from an edge of the plate, and generating a first temperature signal representative of the first plate temperature;

second temperature measuring means for measuring a second plate temperature at a second location between the first location and the edge of the plate and generating a second temperature signal representative of the second plate temperature;

signal processing means for processing the first and second signals to produce a deflection signal proportional to the angular deformation of the plate where the instrument is mounted; and monitoring means for monitoring the deflection signal as a measure of changes in the instrument orientation.

4. A system according to claim 3, including adjustment means for adjusting the instrument in response to changes in the deflection signal.

5. A system according to claim 4, wherein the instrument is mounted to the plate at a fixed orientation and the adjusting means adjust a function of the instrument.

6. A system according to claim 5, wherein the instrument is an optical sight fixed to the plate, the sight including a graticule and the adjusting means comprising means to adjust the graticule.

7. In a military tank or the like having a turret carrying a gun and a gun sight mounted on a roof of the turret, a system for correcting the sight to compensate for thermal deformation of the turret roof, comprising:

mounting means for mounting the sight on the turret roof;

training means linking the sight to the gun for training the sight and gun on a common target;

sight adjustment means for adjusting the aim of the sight relative to the gun;

first temperature measuring means for measuring a first plate temperature at a first location spaced from an edge of the plate and generating a first temperature signal representative of the measured first temperature;

second temperature measuring means for measuring a second plate temperature at a second location between the first location and the edge of the place and generating a second temperature signal representative of the measured second temperature;

initial temperature recording means for recording an initial temperature and generating an initial temperature signal;

signal processing means for combining and processing the first, second and initial temperature signals to produce a deflection signal proportional to the angular deformation of the plate at the mounting means; and circuit means for feeding the deflection signal to the sight adjustment means for adjusting the aim of the sight to correct for plate deformation.

* * * * *